United States Patent [19]

Baker et al.

[11] 4,395,836

[45] Aug. 2, 1983

[54] RELEASE APPARATUS FOR JET-PROPELLED PROJECTILES

[75] Inventors: Alan C. Baker, Huntington Beach, Calif.; Joe T. Zinn, Jr., Mount Lake Terrace, Wash.

[73] Assignee: Brunswick Corporation, Skokie, Ill.

[21] Appl. No.: 206,370

[22] Filed: Nov. 13, 1980

[51] Int. Cl.[3] ..... F41C 27/06

[52] U.S. Cl. ..... 42/1 F; 102/483

[58] Field of Search ..... 42/1 F; 102/483, 377, 102/374; 89/1.808

[56] References Cited

U.S. PATENT DOCUMENTS

| | | | |
|---|---|---|---|
| 109,514 | 11/1870 | Hay | 42/70 F |
| 932,214 | 8/1906 | Wieser . | |
| 1,003,079 | 9/1911 | Wieser . | |
| 2,939,449 | 6/1960 | Kortick . | |
| 3,086,310 | 4/1963 | Katz | 42/70 F |
| 3,165,836 | 1/1965 | Magardo . | |
| 3,245,350 | 4/1966 | Kelly . | |
| 3,332,162 | 7/1967 | Martwick et al. . | |
| 3,442,173 | 5/1969 | Muller . | |
| 3,554,078 | 1/1971 | Horvath . | |
| 3,724,113 | 4/1973 | Ludwig | 42/70 F |

*Primary Examiner*—Charles T. Jordan

*Attorney, Agent, or Firm*—Hosier, Niro & Daleiden

[57] ABSTRACT

A projectile release mechanism is disclosed for facilitating launching of a jet-propelled projectile in the form of a spherical spin-stabilized missile. The apparatus includes a projectile support means which includes a rotary portion having a register section for receiving a unitary nozzle member which is fixed to the missile, for securing the missile to the support means. A fusible joint is formed integral with the unitary nozzle member and is disposed for heating by high-temperature exhaust gas expelled by the missile to release the missile from the rotary portion of the support means. The fusible joint comprises a peripheral ring portion of the unitary nozzle member, which is of a reduced sectional thickness. A plurality of passages are formed through the reduced ring portion for conducting the exhaust gas through the fusible joint. The rotary register section and the unitary nozzle member received therein have complementarily engageable, axially spaced concentric surfaces forming annular flat lands to insure proper alignment of the missile with the spin axis during initial separation of the unitary nozzle member at the fusible joint.

21 Claims, 6 Drawing Figures

RELEASE APPARATUS FOR JET-PROPELLED PROJECTILES

BACKGROUND OF THE INVENTION

This invention relates to a projectile release mechanism for facilitating launching a jet-propelled projectile, and particulary a spherical spin-stabilized missile.

It has become increasingly important to eliminate the features associated with a ballistic trajectory ordinarily followed by rockets and other jet-propelled projectiles, by forming the projectiles as spherical spin-stabilized missiles. The spherical missile spins about an axis upwardly inclined relative to the intended straight line path of flight and aligned with the thrust axis of the propulsion jet of the missile. The missile is released following ignition or activation of the jet propellant within the missile. The propulsion is effected by the reaction of the exhaust jet of, for example, a rocket motor housed within the spherical missile shell.

Often such spherical spin-stabilized missiles are provided in conjunction with attachments secured to the front end of an assault weapon such as a rifle.

Such spin-stabilized spherical jet-propelled missiles experience difficulties in remaining stabilized during attainment of desired rotational speed and in coordinating the spinning and release of the missile. Release of the missile prior to attainment of adequate rotational speed can result in unstable flight. Delay of release after attainment of adequate rotational speed can result in a loss of propulsive range.

Consequently, attempts have been made to provide means for temporarily restraining and automatically releasing a spin-stabilized jet-propelled spherical missile during spinup. For instance, in U.S. Pat. No. 3,245,350 to J. A. Kelly, dated Apr. 12, 1966, a mechanical release is provided between a rifle barrel and a spin-stabilized spherical missile in order to selectively release the missile. However, precise automatic release is not afforded. More specifically, U.S. Pat. No. 3,554,078 to Joseph S. Horvath, dated Jan. 12, 1971, provides a fusible link for temporarily restraining and automatically releasing a spherical spin-stabilized missile during spinup. Release of the spherical rocket missile from its rotary supporting means is effected by causing hot missile rocket exhaust gas to weaken by heating or to heat and soften or melt a separate fusible link member which, prior to weakening by softening or melting, secures the missile to the rotary support means. In this patent, the separate fusible link member is of the nature of a brazing alloy serving as one part of a nozzle assembly to secure the rocket to the rotary support means. The fusible link member actually is brazed between two additional nozzle members which secure the missile to the support means. Such assembly and brazing operations not only are time consuming during manufacture but can be inaccurate and can result in increased costs as well.

The present invention is directed to providing a new and improved nozzle assembly which includes a unitary nozzle member having fusible joint means formed integrally therewith, between the missile and the rotary support means, thereby eliminating the aforsaid assembly and brazing operations and thereby considerably reducing manufacturing costs and improving accuracy.

Another problem experienced in spin-stabilized spherical jet-propelled missiles of the character described, is in the supporting and orienting means of the missile for accurate alignment about a spin axis as rotational speed is attained. The present invention provides a new and improved means between the missile exhaust nozzle and the rotary support means to insure proper alignment of the missile with its launching spin axis during initial separation of the integral fusible joint means.

SUMMARY OF THE INVENTION

An object, therefore, of the present invention is to provide a new and improved projectile release mechanism for facilitating launching a jet-propelled projectile.

Another object of the invention is to provide a new and improved fusible joint means formed integrally with a unitary nozzle member extending from and securing the missile to its rotary support means.

A further object of the invention is to provide a novel land means between the nozzle member and the rotary support means to insure proper alignment of the missile with the launching spin axis during initial separation of the fusible joint means.

In the exemplary embodiment of the invention, the release mechanism includes a projectile support means which is shown herein as attachable to the barrel of an assault weapon such as a rifle. The support means includes rotary means and means for supporting the rotary means for rotation about a spin axis coaxial with a nozzle member secured between the missile and the rotary means. The nozzle member is a unitary component and includes a fusible joint means formed integrally therewith and disposed for heating by high-temperature exhaust gas expelled by the missile to release the missile from the rotary support means on weakening by softening and melting the integral fusible joint means.

The fusible joint means includes a peripheral ring portion of the unitary nozzle member, the ring portion being of a reduced sectional thickness. A plurality of passages are formed through the reduced ring portion for conducting the exhaust gas through the fusible joint means. In this manner, the precise timing of release of the missile can be accurately controlled simply by the particular material of which the unitary nozzle member is fabricated, along with machining of the integral reduced ring portion of the nozzle member and by controlling the size and shape of the passages. There is no assembly, brazing, or secondary machining operations necessary as is prevalent with prior art fusible link constructions.

The rotary support means includes a socket-type register section which forms a receptacle for the unitary nozzle member. The unitary nozzle member is threaded at opposite ends for engagement with complementarily threaded receptacle means within the register section of the rotary means as well as the missile itself. Complementarily engageable, axially spaced concentric surfaces form land means between the register section and the unitary nozzle member to insure proper alignment of the missile with the launching spin axis during initial separation of the nozzle member at the fusible joint.

In particular, the land means on each of the socket-type register section and the nozzle member comprises a pair of axially spaced, radially protruding flat ring-type flange members disposed axially outwardly of the fusible joint.

Other objects, advantages and features of the invention will be apparent from the following detailed description taken in conjunction with the accompanying drawings.

DETAILED DESCRIPTION OF THE INVENTION

Figure 1:
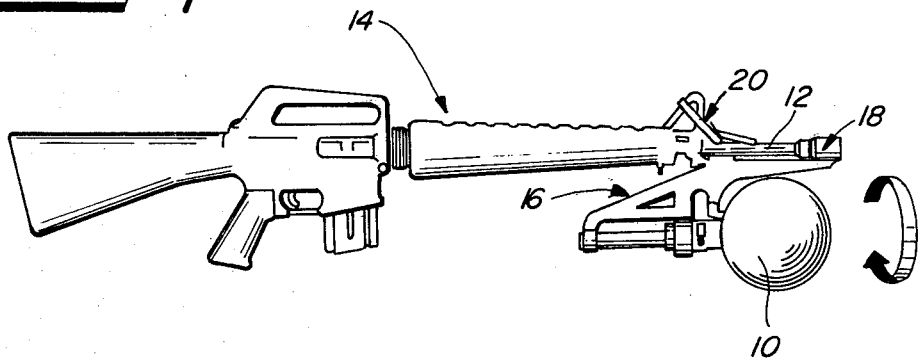
FIG. 1 is an elevational view of a spherical spin-stabilized missile mounted on the barrel of a rifle and incorporating the release mechanism of the present invention.

Referring to the drawings in greater detail, and first to FIG. 1, a spherical spin-stabilized jet-propelled missile 10 is shown mounted to the front of a barrel 12 of an assault weapon such as a rifle, generally designated 14. The rifle shown is a standard M-16A1 military rifle.

Figure 2:
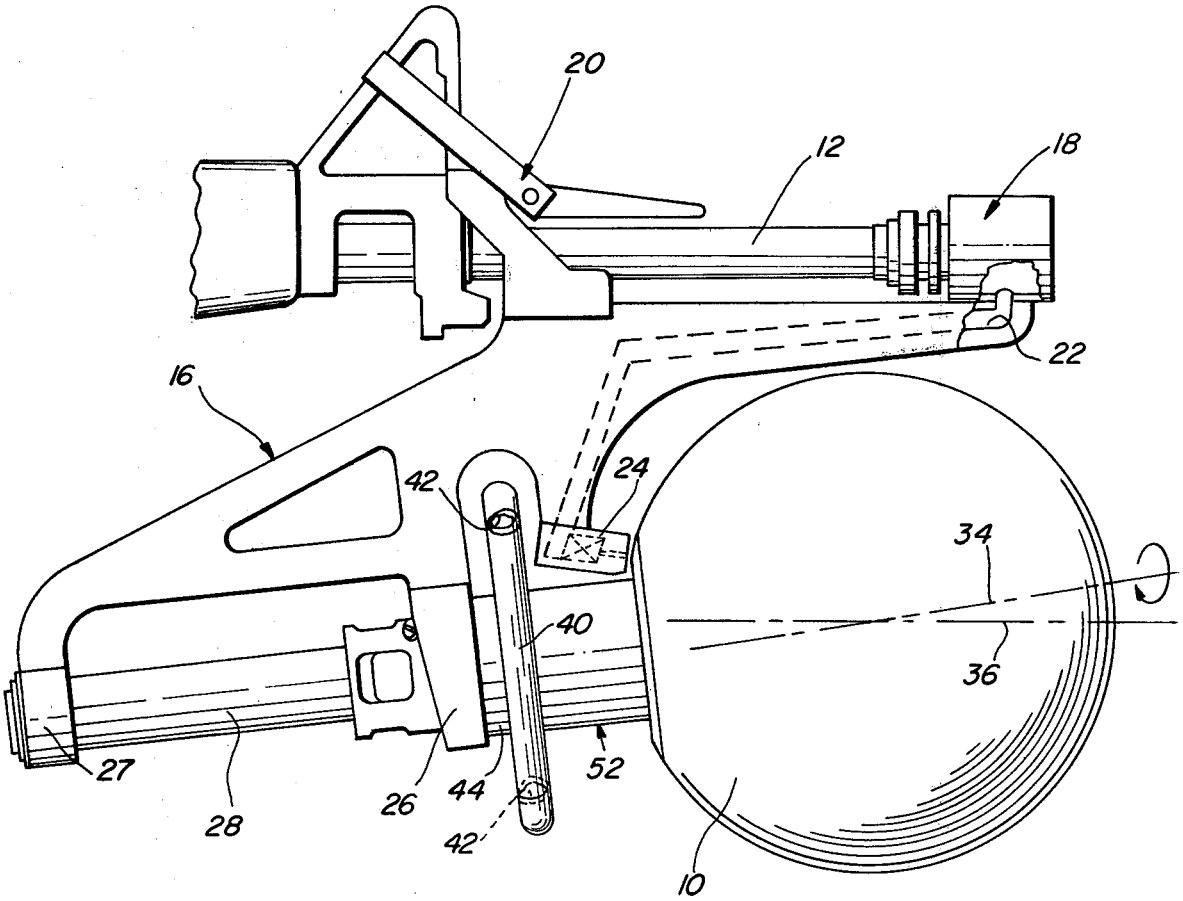
FIG. 2 is a fragmented side elevational view, on an enlarged scale of the spherical missile mounted on the front end of the rifle barrel.

As shown in FIG. 1 and in the enlarged view of FIG. 2, a missile support means, generally designated 16, includes a front upper bracket portion, generally designated 18, and a rear upper latch portion, generally designated 20. Bracket portion 18 is positioned on the barrel 12 whereby part of the gas emanating from the barrel is channeled through a passageway 22 to a pneumatically actuated pin assembly 24 which is effective to strike a primer on missile 10 to ignite the rocket propellant therein, as is known in the art. Latch 20 simply is provided to lock support means 16 onto the rifle barrel.

Support means 16 also includes turbine support portions 26 and 27, and a launcher shaft 28. Launcher shaft 28 is disposed on an axis 34 upwardly inclined relative to an intended straight line path of flight 36 generally parallel to the axis of rifle barrel 12. As is known in the art, axis 34 is the spin axis of missile 10: i.e., the motor thrust of the missile rocket motor. Axis 36 which defines the line of flight of the missile is the forward velocity component thereof.

Figure 3:
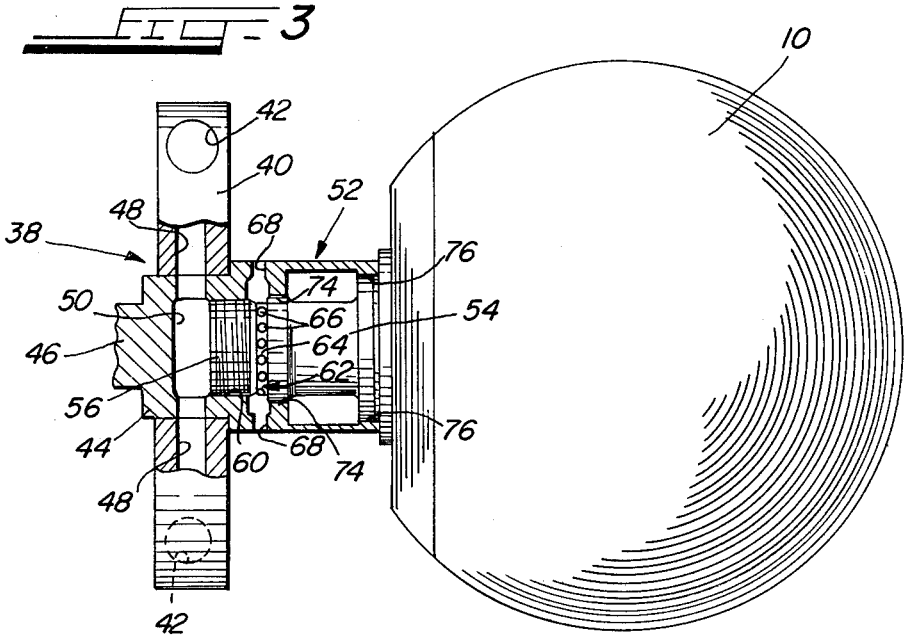
FIG. 3 is a side elevational view of the spherical missile and release mechanism of the present invention, with portions of the rotary support means fragmented and in section to better illustrate the release mechanism.

Referring to FIG. 3, rotary means, generally designated 38, includes a turbine 40 having turbine nozzles 42. The turbine is fixed to a hub 44 which forms an extension of shaft 28 (FIG. 2) and which extends rearwardly thereof. In assembly, shaft 28 protrudes rotatably within turbine support means 26 and 27 (FIG. 2). Appropriate bearings or bushings (not shown) are disposed in turbine support portions 26 and 27. Turbine 40 also has radial passages 48 in communication with turbine nozzles 42 and in communication with a central cavity 50 within shaft hub 44. As further shown in FIG. 3, rotary means 38 also includes a register section, generally designated 52, formed integrally with and protruding outwardly from hub 44. This register section defines an adapter or socket-type receptacle means for a unitary member 54 which extends between missile 10 and rotary means 38 for securing the missile to the rotary means and thus to support means 16. The unitary nozzle member 54 is shown in the enlarged view of FIG. 5.

Figure 5:
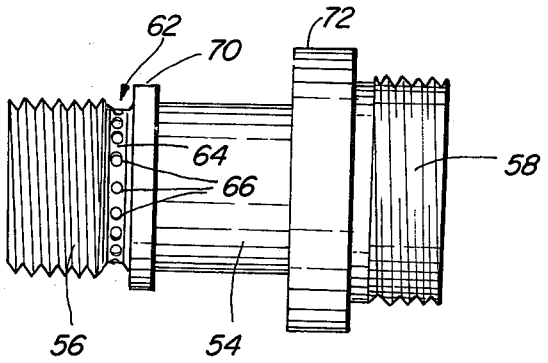
FIG. 5 is a side elevational view, on a further enlarged scale, of the unitary nozzle member of the present invention, incorporating the fusible joint means.
Figure 6:
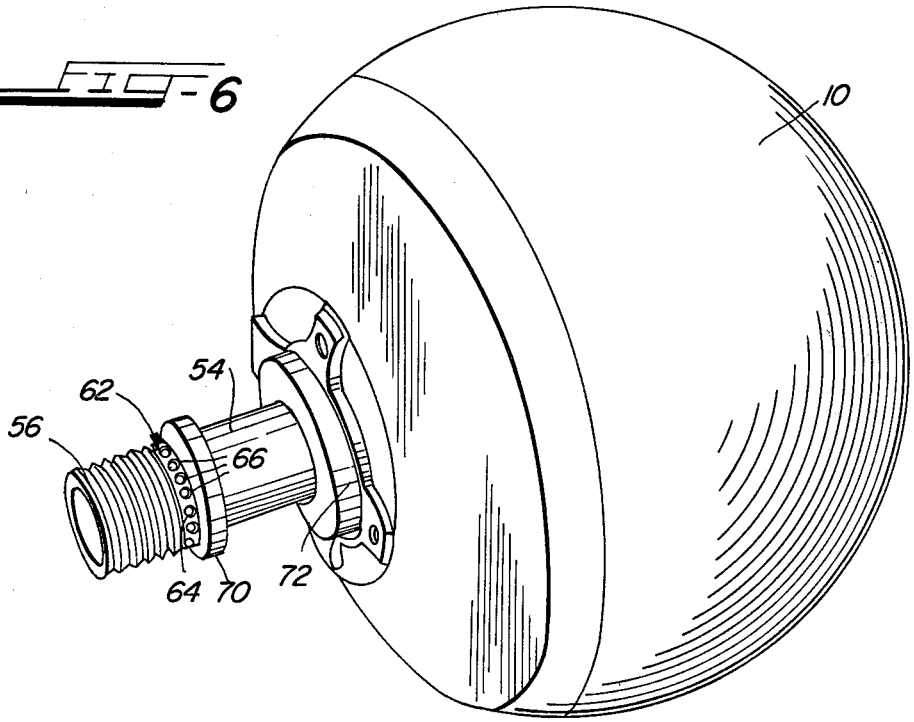
FIG. 6 is a perspective view of the spherical missile with the unitary nozzle member of FIG. 5 in threaded engagement therewith.

Referring to FIG. 5, unitary nozzle member 54 comprises a disposable, generally tubular member which is threaded at opposite ends thereof, as at 56 and 58, for engagement with rotary support means 38 and missile 10. Specifically, threaded end portion 56 is secured in engagement within a complementarily threaded interior portion 60 (FIG. 3) of register section 52 of rotary means 38. The opposite threaded end 58 is secured within a complementarily threaded receptacle (not shown) in missile 10.

The unitary nozzle member 54 of the present invention includes a fusible joint means, generally designated 62, formed integrally with the unitary nozzle member and disposed for heating by high-temperature exhaust gas expelled by missile 10 to release the missile from support means 16 and particularly rotary means 38. More particularly, fusible joint means 62 comprises a peripheral ring portion 64 which is reduced in sectional thickness by appropriate machining operations. A plurality of passages 66 extend through the reduced ring portion for conducting the exhaust gas through fusible joint means 62.

It is readily apparent that the precise timing of the release of missile 10 can be accurately controlled by the selection of the particular material of which the unitary nozzle is fabricated, the simple operation of machining peripheral ring portion 64 to a desired thickness and by varing the number and sizes of the passages 66 which, in part, are determined by the amount of heat which can be measured experimentally from the exhaust gases of the missile. No other assembly, brazing, or additional manufacturing operations are required becuase the nozzle assembly for the missile is fabricated of the one-piece nozzle member 54.

Figure 4:
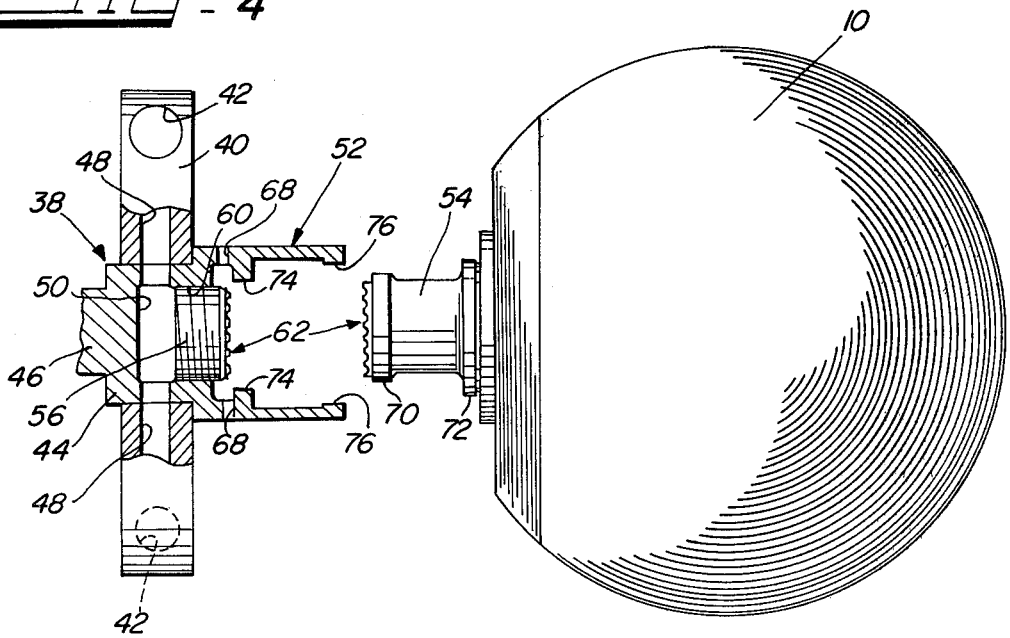
FIG. 4 is a view similar to that of FIG. 3, with the spherical missile released after melting of the fusible joint means.

Referring back to FIG. 3, a pair of vent ports 68 are formed in register section 52 for the escape of gases which pass through passages 66 in fusible joint means 62. The remainder of the gases from the rocket motor within missile 10 pass through nozzle member 54 and outwardly through passages 48 and turbine nozzles 42 to cause the entire rotary means 38 to spin about shaft 46 relative to the overall support means 16 mounted on rifle barrel 12. After the missile reaches a predetermined spinup, as determined by the material of nozzle member 54 and the machining of fusible joint means 62, the fusible joint will melt and erode and the missile will separate as shown in FIG. 4 and follow the line of flight designated by axis 36 in FIG. 2.

This invention also includes improved means to insure proper alignment of the missile with launching spin axis 36 during initial separation of the fusible joint means, as described above. More particularly, unitary nozzle member 54 forms an extension member of the missile and includes a pair of axially spaced, radially protruding, flat ring-type flanges 70 and 72 which define axially spaced concentric surfaces forming annular land means. Similarly, a pair of axially spaced radially inwardly protruding flat lands 74 and 76 are formed on the interior of register section 52 for complementary engagement with lands 70 and 72, respectively, of unitary nozzle member 54. With this structure, the complementarily engageable, axially spaced land means prevent wobbling of the missile during spinup which might result in a loss of accuracy in launching the missile along spin axis 34, and the land means insures proper alignment of the missile with the spin axis during initial separation of the unitary nozzle member 54 at fusible joint means 62.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

We claim:

1. A projectile release mechanism for facilitating launching a jet-propelled projectile, comprising:

projectile support means; and a one-piece, homogeneous nozzle member extending between said projectile and said support means and including means for securing the projectile to the support means, said one-piece nozzle member including a fusible portion formed as an integral part of said one-piece nozzle member and disposed for heating by high-temperature exhaust gas expelled by said projectile to release said projectile from said support means.

2. The projectile release mechanism of claim 1 wherein said fusible portion has passage means therethrough for conducting said exhaust gas through said fusible portion.

3. The projectile release mechanism of claim 1 wherein said jet-propelled projectile comprises a spin-stabilized missile, and said support means includes rotary means and means for supporting said rotary means for rotation about a spin axis coaxial with said nozzle member, said nozzle member being secured to said rotary means.

4. The projectile release mechanism of claim 3 wherein said nozzle member comprises a disposable tubular member which is threaded at opposite ends for engagement with complementary threaded receptacle means on said missile and said rotary means.

5. The projectile release mechanism of claim 1 wherein said nozzle member comprises a disposable tubular member which is threaded at opposite ends for engagement with complementary threaded receptacle means on said projectile and said support means, with said fusible portion being disposed intermediate the threaded opposite ends of the tubular member.

6. A projectile release mechanism for facilitating launching a jet-propelled projectile, comprising:

a projectile support means;

a unitary nozzle member extending between said projectile and said support means for securing the projectile to the support means; and fusible joint means formed integral with said unitary nozzle member and disposed for heating by high-temperature exhaust gas expelled by said projectile to release said projectile from said support means, said fusible joint means including a peripheral ring portion of said unitary nozzle member of a reduced sectional thickness.

7. The projectile release mechanism of claim 6 wherein said fusible joint means further includes a plurality of passages of appropriate size and shape through said reduced ring portion for conducting said exhaust gas through said fusible joint means.

8. A projectile release mechanism for facilitating launching a jet-propelled projectile which comprises a spin-stabilized missile, comprising:

a projectile support means including rotary means and means for supporting said rotary means for rotation about a spin axis, said rotary means including a register section;

a unitary nozzle member extending between said projectile and said support means for securing the projectile to the support means, the unitary nozzle member being secured to said rotary means and received by said register section coaxial with said spin axis, said unitary nozzle member comprising a disposable tubular member which is threaded at opposite ends for engagement with complementary threaded receptacle means on said missile and said rotary means, and said register section and said nozzle member having complementarily engageable, axially spaced concentric land means to insure proper alignment of said missile with said spin axis during initial separation; and fusible joint means formed integral with said unitary nozzle member and disposed for heating by high-temperature exhaust gas expelled by said projectile to release said projectile from said support means.

9. A projectile release mechanism for facilitating launching a jet-propelled projectile, comprising:

a projectile support means;

a unitary nozzle member extending between said projectile and said support means for securing the projectile to the support means;

fusible joint means formed integral with said unitary nozzle member and disposed for heating by high-temperature exhaust gas expelled by said projectile to release said projectile from said support means; and said support means including a register section for receiving said unitary nozzle member, said register section and said nozzle member having complementarily engageable, axially spaced concentric land means to insure proper alignment of said projectile during initial separation of said nozzle member at said fusible joint means.

10. A release mechanism for facilitating launching of a spin-stabilized spherical jet-propelled missile having an exhaust nozzle, said release mechanism comprising:

support means including rotary means and means for supporting said rotary means for rotation about a spin axis coaxial with said exhaust nozzle;

a unitary nozzle member extending between said rotary means and said missile coaxial with said spin axis and in communication with said missile exhaust nozzle for securing said missile to said support means; and fusible joint means formed integral with said unitary nozzle member and disposed for heating by high-temperature exhaust gas expelled by said missile through said exhaust nozzle to release said missile from said support means, said fusible joint means including a peripheral ring portion of said unitary nozzle member of a reduced sectional thickness and a plurality of passages through said reduced ring portion for conducting said exhaust gas through said fusible joint means.

11. The release mechanism of claim 10 wherein said unitary nozzle member comprises a disposable tubular member which is threaded at opposite ends for engagement with complementarily threaded receptacle means on said missile and said rotary means.

12. The release mechanism of claim 10 wherein said rotary means includes a register section for receiving said unitary nozzle member, said register section and said unitary nozzle member having complementarily engageable, axially spaced concentric land means to insure proper alignment of said spin axis during initial separation of said unitary nozzle member at said fusible joint means.

13. A projectile release mechanism for facilitating launching a projectile, comprising:

a projectile support means including receptacle means defining a launching axis for said projectile;

an extension member fixed to said projectile for axially mating with said receptacle means;

separation means between said projectile and said support means; and complementarily engageable, axially spaced land means between said receptacle means and said extension member to insure proper alignment of said projectile with said launching axis during initial separation of said separation means.

14. The projectile release mechanism of claim 13 wherein said receptacle means comprises a socket-type register section for receiving said extension member of said projectile, with said complementarily engageable land means protruding inwardly of said register section and outwardly of said extension member.

15. The projectile release mechanism of claim 14 wherein said land means on each of said socket-type register section and said extension member comprises at least a pair of axially spaced, radially protruding, flat ring-type flange members defining concentric flat surfaces.

16. A release mechanism for facilitating launching of a spin-stabilized spherical jet-propelled missile having an exhaust nozzle, said release mechanism comprising:

missile support means including rotary means and means for supporting said rotary means for rotation about a spin axis coaxial with said exhaust nozzle, said rotary means including receptacle means defining said spin axis;

a nozzle assembly on said missile, including a nozzle member extending between said missile and said support means in communication with said exhaust nozzle for securing said missile to said support means, said nozzle member extending into and mating with said receptacle means;

separation means between said missile and said support means; and complementarily engageable, axially spaced land means between said receptacle means and said nozzle member to insure proper alignment of said missile with said spin axis during initial separation of said separation means.

17. The release mechanism of claim 16 wherein said receptacle means comprises a socket-type register section for receiving said nozzle member, with said complementarily engageable land means protruding inwardly of said register section and outwardly of said nozzle member.

18. The release mechanism of claim 17 wherein said land means on each of said socket-type register section and said nozzle member comprises at least a pair of axially spaced, radially protruding, flat ring-type flange members defining concentric flat surfaces.

19. The release mechanism of claim 16 wherein said separation means comprises fusible joint means on said nozzle assembly.

20. The release mechanism of claim 19 wherein said land means is disposed within said receptacle means axially outwardly of said fusible joint means.

21. The release mechanism of claim 20 wherein said nozzle member comprises a disposable tubular member which is threaded at opposite ends for engagement with complementarily threaded portions on said missile and said receptacle means.

* * * * *